US005653187A

United States Patent [19]

Kawamoto et al.

[11] Patent Number: 5,653,187

[45] Date of Patent: Aug. 5, 1997

[54] UPPER FEED MECHANISM FOR SEWING MACHINE AND SEWING MACHINE HAVING THE SAME

[75] Inventors: Osamu Kawamoto, Tokyo, Japan; Wolf von Hagen, Hemmingen, Germany

[73] Assignees: Juki Corporation, Tokyo, Japan; Union Special Corporation, Huntley, Ill.

[21] Appl. No.: 531,955

[22] Filed: Sep. 21, 1995

[30] Foreign Application Priority Data

Sep. 22, 1994 [JP] Japan ..... 6-228137

[51] Int. Cl.[6] ..... D05B 27/06

[52] U.S. Cl. ..... 112/320

[58] Field of Search ..... 112/320, 323, 112/220, 165, 197, 235, 222, 302, 284, 221

[56] References Cited

U.S. PATENT DOCUMENTS

| | | | |
|---|---|---|---|
| 670,340 | 3/1901 | Catenacci et al. | 112/320 |
| 1,017,164 | 2/1912 | Noble | 112/320 |
| 2,033,294 | 3/1936 | Paine | 112/320 |
| 2,820,426 | 1/1958 | Doerr et al. | 112/320 |
| 3,828,704 | 8/1974 | Von Hagen et al. | 112/320 |
| 4,416,586 | 11/1983 | Scholl | 112/320 |
| 4,422,398 | 12/1983 | Dusch | 112/320 |
| 5,209,172 | 5/1993 | Kawaguchi et al. | 112/320 |

*Primary Examiner*—Ismael Izaguirre
*Attorney, Agent, or Firm*—Morgan, Lewis and Bockius, LLP

[57] ABSTRACT

A sewing machine with an upper feed mechanism includes: a sewing machine head; a needle plate; first, second and third shafts each extending from the sewing machine head vertically downwardly toward the needle plate, each shaft having a lower end; a needle secured to the lower end of the first shaft; a feed element having one end carried by the lower end of the second shaft and the other end located forwardly of the path of the needle; an upper feed dog formed in the other end of the feed element and confronting the needle plate; and a presser foot mounted to the lower end of the third shaft, wherein the first, second and third shafts being moved in timed relation to one another so as to allow a workpiece to be sandwiched between the presser foot and the needle plate, and the upper feed dog cooperating with a lower feed dog located below the needle plate to clamp and feed the workpiece to the path of the needle whereby stitches are formed, and wherein the first, second and third shafts are juxtaposed in that order in the direction in which the workpiece is fed.

10 Claims, 3 Drawing Sheets

UPPER FEED MECHANISM FOR SEWING MACHINE AND SEWING MACHINE HAVING THE SAME

BACKGROUND OF THE INVENTION

1. Field of the Invention

This invention relates to an upper-feed type sewing machine with an upper feed dog to clamp and feed cloth as a workpiece in cooperation with a lower feed dog.

2. Description of Related Art

In a sewing machine, a workpiece to be sewn is held between a presser foot and a needle plate. The pressor foot is mounted to a machine head and extends across a needle path (or a needle drop position). The needle path plate is placed on a machine bed. Generally, feeding the workpiece is achieved by a lower feed dog provided below the needle plate so as to impart a feed motion to the workpiece. During operation of the machine, a known lower feed mechanism is effective to impart to the lower feed dog a predetermined motion, typically, an elliptical motion in a vertical plane along workpiece direction of travel. The lower feed dog, when at the upper portion of the elliptical motion thereof, rises above the needle plate and then, cooperates with the presser foot to clamp and feed the workpiece.

A disadvantage of the arrangement thus constructed is that the lower feed dog is effective to impart a feeding motion to the only underside of the workpiece. For example, where a plurality of plies of material are superimposed, it is likely that the lower workpiece to which a feeding motion is imparted is displaced from the upper workpiece which slides on the presser foot. To obtain a high quality product, an operator is required to finely adjust the advancement of the material.

To that end, an upper feed mechanism is incorporated into sewing machines such as a covering chain stitch sewing machine and a multi-thread chain stitch sewing machine wherein a plurality of superimposed workpieces are stitched together. The upper feed mechanism includes a feed dog (upper feed dog) provided above the needle plate and located forwardly of the path of a needle. The upper and lower feed dogs are operatively associated with one another to clamp the workpieces on the needle plate. A feeding motion is conducted on opposite sides of the workpieces.

FIG. 4 is a side view, in section, of a part of a conventional sewing machine with such an upper feed mechanism, located adjacent to the path of a needle. In FIG. 4, A designates a sewing machine head, and B designates a sewing machine bed. A needle plate C is placed on the bed B and is situated below the head A. The sewing machine is operable to form stitches while a workpiece is fed across the needle plate C and moved to the left in FIG. 4.

A needle bar 54, a presser bar 55, and an upper feed bar 56 each extend vertically downwardly toward the needle plate C and are juxtaposed in this order in the direction in which workpieces W1 and W2 are fed.

The needle bar 54 is supported by a bushing 57 which is, in turn, fixedly mounted within the machine head A and vertically slidable within the bushing 57. A needle 58 is secured to the lower end of the needle bar 54 and moved up and down by means of a main shaft (not shown) within the machine head A. Three (or two) needles 58 may be provided such that they are arranged perpendicular to the feeding direction, and the corresponding number of the needle bars 54 may be provided.

The presser bar 55 located downstream from the needle bar 54 is also supported by a bushing 59 which is, in turn, fixedly mounted to the machine head A and vertically slidable within the bushing 59. A presser foot 62 is mounted to the lower end of the presser bar 55 via a presser holder 60 and a presser arm 61. The presser holder 60 is secured to the lower end of the presser bar 55. The presser arm 61 has an upper end mounted to the presser holder 60 at a position offset from the central axis of the presser holder 60 and swingable about a pivot pin 63. The presser foot 62 is swingably mounted to the lower end of the presser arm 61 through a pivot pin 64. The presser bar 55 has a hollow structure to receive a presser spring 65. The presser spring 65 has an upper end engaged with the lower end of a threaded stopper (not shown) threaded into the upper end of the presser bar 55. Also, the lower end of the presser spring 65 is engaged with the upper end of the presser arm 60.

With this arrangement, the presser foot 62 is urged downwardly against the needle plate C under the action of the presser spring 65. When the workpieces W1 and W2 are fed on the needle plate C, and when an upward force is applied through the workpieces to the presser foot 62 against the action of the presser spring 65, the presser arm 61 is swung about the pivot pin 63 to cause the presser foot 62 to cooperate with the upper surface of the needle plate C to clamp the workpieces W1 and W2. At this time, the presser foot 62 is swung about the pivot pin 64 so as to change its angle of inclination relative to the presser arm 61. Thus, the workpieces W1 and W2 can constantly be clamped between the needle plate C and the entire upper surface of the presser foot 62.

The upper feed bar 56 is located downstream the presser bar 55 and has a central portion extending through a bushing 66. The upper feed bar 56 is manually axially movable within the bushing 66. The bushing 66 is carried by the machine head A and swingable back and forth. A feed element 68 is mounted to the lower end of the upper feed bar 56 through a feed holder 67. The feed element 68 is an elongated plate-like member and has a rear end pivotally mounted to the feed holder 67 through a pivot pin 69. The feed element 68 extends on one side of each of the presser foot 62 and the needle 68 and terminates at an upper feed dog 70. The upper feed dog 70 is located forwardly of the needle 58 and confronts the upper surface of the needle plate C.

The upper end of the upper feed bar 56 is connected through a known transmission mechanism to a main shaft (not shown) within the machine head A. Rotation of the main shaft causes simultaneous swing and axial motions of the upper feed bar 56 within the bushing 66. The combined swing and axial motions then give the lower end of the upper feed bar 56 an elliptical motion in a plane in which the central axis of the upper feed bar 56 is included and in the direction in which the workpieces W1 and W2 are fed. As a result an elliptical motion is imparted to the feed dog 70 mounted to the distal end of the feed element 68 which is, in turn, mounted to the lower end of the upper feed bar 56.

The upper feed dog 70 and a lower feed dog 71 below the needle plate C are driven both through an elliptical path, but in opposite directions. When the upper feed dog 70 is moved down, the lower feed dog 71 is moved up or closer to the upper feed dog 70. Thereafter, the upper feed dog 70 and the lower feed dog 71 are both moved to the rear in the direction of workpiece travel. This arrangement allows the upper feed dog 70 and the lower feed dog 71 to clamp the workpieces W1 and W2 fed on the needle plate C. Thus, a feed motion is imparted to opposite sides of the workpieces to properly move the workpieces to a needle path and eliminate displacement between the lower workpiece W2 and the upper workpiece W1 as stated above.

This type of sewing machine includes an additional lower feed dog 72 behind the lower feed dog 71 which cooperate with the upper feed dog 70 to impart a feed motion to the workpieces W1 and W2. The lower feed dog 72 is moved with the lower feed dog 71 to impart a feed motion to the workpieces W1 and W2 held between the presser foot 62 and the lower feed dog. This arrangement ensures proper advancement of the workpieces.

However, in the conventional sewing machine thus constructed, as the upper feed bar 56 is located behind the presser bar 55 as seen from the needle bar 54, the fulcrum (pivot pin 69) of the feed element 68 carried by the lower end of the upper feed bar 56 is located furthest away from the upper feed dog 70 or a working point. This results in an increase in the length and size of the feed element 68. Accordingly, its moment increases. In such a case, the upper feed dog 70 cannot be moved in response to the motion of the lower feed dog 71 when the sewing machine is operated at high speeds. Also, the upper feed dog 70 is subjected to bounce, and thus creating difficulty in obtaining a proper feed force.

To prevent the bouncing of the upper feed dog 70, the force of a spring (not shown) disposed on the presser bar 56 could be increased. In such a case, however, the upper feed dog 70 and the lower feed dog 71 may unduly clamp and cause damage to workpieces being sewn. Care should therefore be taken when the conventional sewing machine is used to sew knitted or other fragile garments at high speeds.

To form a flat seam, the sewing machine of this type is required to include a spreader mechanism with a swing arm adapted to feed a cover thread to a location immediately before the path of a needle. The cover thread is interwoven between and connects a plurality of needle threads. However, it is difficult to arrange a drive shaft for use in the swing arm of the spreader mechanism in such a location as to form an appropriate seam because the moving components of the presser and upper mechanisms are closely arranged in that location.

SUMMARY OF THE INVENTION

Accordingly, an object of the present invention is to provide a sewing machine with an upper feed mechanism, which prevents bouncing of the upper feed dog during high speed operation of the machine and can impart a proper feed motion. Also, the present invention provides a sewing machine with an upper feed mechanism, which includes a swing arm adapted to feed a thread to a location immediately forward of a needle. The thread is moved in a direction transversely of the needle threads In order to achieve the above objects, there is provided a sewing machine with an upper feed mechanism which comprises: a sewing machine head; a needle plate; first, second and third shafts each extending from the sewing machine head vertically downward toward the needle plate, each shaft having a lower end; a needle secured to the lower end of the first shaft; a feed element having one end carried by the lower end of the second shaft and the other end located forwardly of the path of the needle; an upper feed dog formed in the other end of the feed element and confronting the needle plate; and a presser foot mounted to the lower end of the third shaft, wherein the first, second and third shafts are moved in timed relation to one another so as to allow a workpiece to be sandwiched between the presser foot and the needle plate, and the upper feed dog cooperating with a lower feed dog located below the needle plate to clamp and feed the workpiece to the path of the needle whereby stitches are formed, and wherein the first, second and third shafts are juxtaposed in the order in which the direction of the workpiece is fed.

In the sewing machine of the present invention, it is preferable to provide a swing arm for feeding a thread to a location immediately forward of the needle. The thread is moved in a direction transversely of the needle threads. The swing arm may be rotatably mounted to the third shaft or journaled in a bearing in coaxial relation to the third shaft.

According to the present invention, the second drive shaft for driving the feed element is located between the first drive shaft for driving the needle and the third drive shaft for driving the presser foot. This arrangement permits the distance between the fulcrum of the feed element carried by the lower end of the second drive shaft and the upper feed dog as a working point to be substantially shorter than that in the conventional sewing machine. The feed element can be shorter, smaller and lighter than that used in the conventional sewing machine. Thus, the feed element has smaller moments to permit the upper feed dog to be better responsive to the rapid motion of the lower feed dog. Also, the upper feed dog will not bounce unless the sewing machine is operated at a substantially high speed.

The sewing arm is rotatably mounted to the third drive shaft or journaled in a bearing in coaxial relation to the third drive shaft. The drive shaft is effective to drive both the presser foot and the swing arm. Advantageously, this arrangement allows the swing arm to be mounted in a space wherein the moving components of various mechanisms are closely arranged.

Also, the third drive shaft is more distant than the second drive shaft from the first drive shaft for the needle. As the swing arm is mounted to this third shaft for rotation in a horizontal plane, it can be rotated with a greater radius and can feed a thread to be interwoven between a plurality of needle threads.

DETAILED DESCRIPTION OF THE PREFERRED EMBODIMENTS

The present invention will now be described by way of example with reference to FIGS. 1 to 3.

Figure 1:
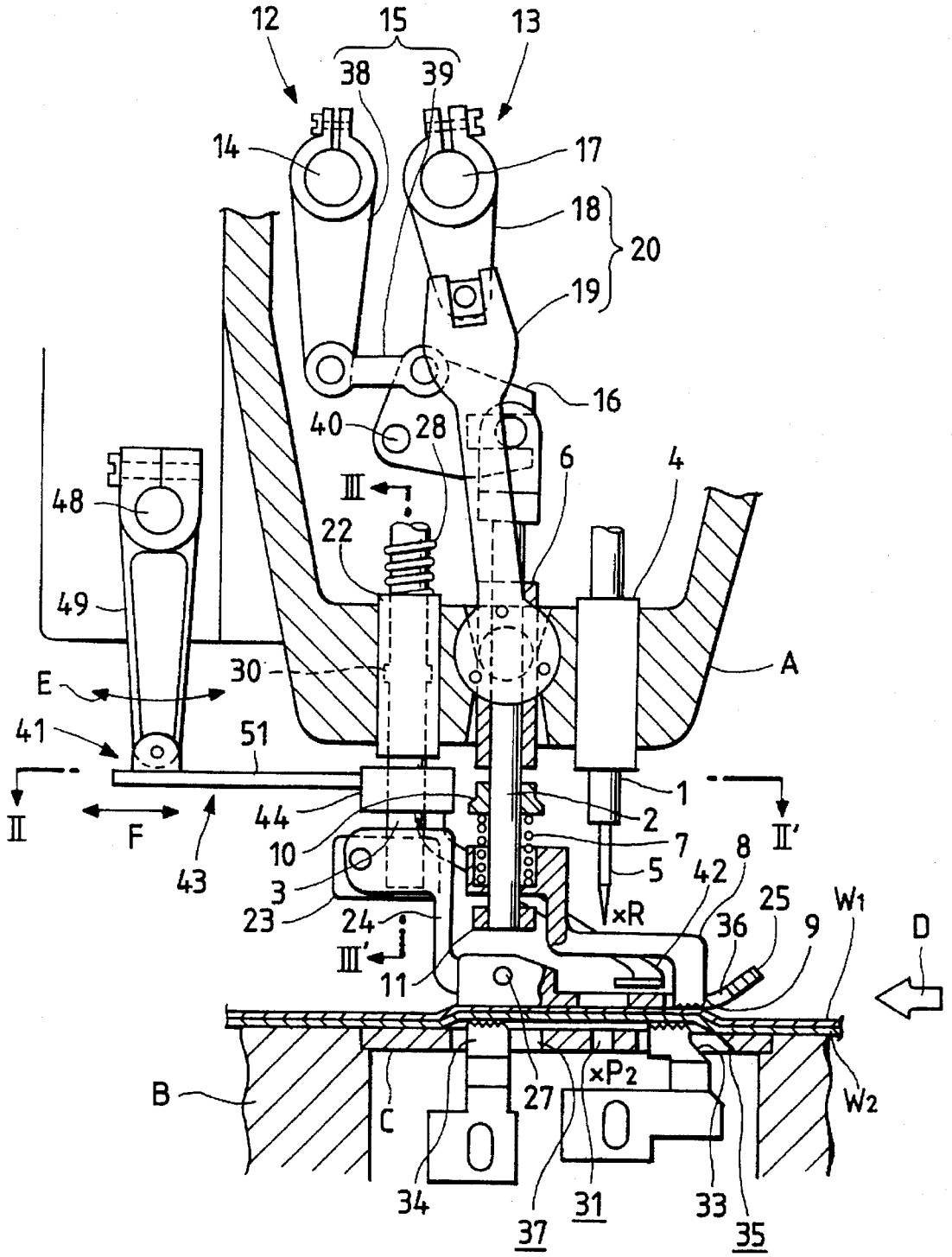
FIG. 1 is a sectional side view of a part of a sewing machine with an upper feed mechanism, located adjacent to the path of a needle, according to one embodiment of the present invention.

FIG. 1 is a sectional side view of a part of a sewing machine with an upper feed mechanism, located adjacent to a needle path. FIG. 2 is a sectional view taken along the line II—II of FIG. 1. FIG. 3 is a sectional view taken along the line III—III of FIG. 1. Of these, FIGS. 2 and 3 show a spreader mechanism incorporated in the sewing machine according to the present invention.

In FIG. 1, reference numeral A designates a sewing machine head, and B designates a sewing machine bed. A needle plate C is placed on the bed B and situated below the head A. The sewing machine is operable to form stitches while a workpiece is fed across the needle plate C and moved to the left in FIG. 1.

A needle bar 1 as a first shaft, an upper feed bar 2 as a second shaft, and a presser bar 3 as a third shaft all extend vertically downwardly toward the needle plate C and are juxtaposed in this order in the direction in which workpieces W1 and W2 are fed.

The needle bar 1 is supported by a bushing 4 which is, in turn, fixedly mounted within the machine head A and vertically slidable within the bushing 4. A needle 5 is secured to the lower end of the needle bar 1 and moved up and down by means of a main shaft (not shown) within the machine head A. In this embodiment three (or two) needles 58 are provided such that they are arranged perpendicularly to the feeding direction, and the corresponding number of the needle bars 1 are provided. Only one needle 5 and one needle bar 1 are shown in these figures.

Three (or two) holes 31 extend through the thickness of the needle plate C and are located exactly below each needle 5 carried by the needle bar 1. Vertical movement of the needle bar 1 causes the bottom tip of the each needle 5 to vertically move between the uppermost position P1 above the upper surface of the needle plate C and the lowermost position P2 below the lower surface of the needle plate C. During this stroke of the needle 5, stitches are formed in the workpieces W1 and W2 on the needle plate C.

An upper feed bar 2 is located behind the needle bar 1. The upper feed bar 2 has a central portion extending through a bushing 6 and is adapted to slide axially within the bushing 6. The bushing 6 is carried by the machine head A and is swingable back and forth. A feed element 8 is secured to the lower end of the upper feed bar 2, as shown, is bent at a few points. The feed element 8 has one end (rear end) fit around the upper feed bar 2. The feed element 8 extends forwardly from the upper feed bar 2, passes one side of the needle 5, and terminates at an upper feed dog 9. The upper feed dog 9 is located forwardly of the needle 5 and confronts the upper surface of the needle plate C. The feed element 8 is axially movable along the upper feed bar 2 and constantly biased downwardly by a coil spring 7. The coil spring 7 is disposed around the lower portion of the upper feed bar 2. A flange 10 is formed around the middle portion of the upper feed bar 2 to engage the upper end of the coil spring 7. A stopper 11 is mounted to the lower end of the upper feed bar 2 to prevent release of the coil spring 7 from the upper feed bar 2.

The upper end of the upper feed bar is connected through two different transmission mechanisms 12 and 13 to a main shaft (not shown) within the machine head A.

The transmission mechanism 12 is effective to move the upper feed bar 2 up and down and includes a drive shaft 14 vertically swingable by an eccentric cam shaft (not shown) which is in turn, mounted to the main shaft. The swing motion of the drive shaft is transmitted through two arms 38 and 39 of a drive link mechanism 15 and a forked bracket 16 which is pivotable about the horizontal axis of the presser bars 3 to cause axial motion of the upper feed bar 2 within the bushing 6. The pivot pin 40 is urged douwnwardly by a spring (not shown), or a presser spring 28, which urges the pressure bar 3.

The other transmission mechanism 13 is effective to cause swing motion of the upper feed bar 2. A horizontal drive shaft 17 is swingable by an eccentric cam shaft (not shown) mounted to the main shaft. The swing motion of the drive shaft 17 is transmitted through an arm 18 fixedly mounted to the drive shaft 17 and an arm 19 secured to the bushing 6 of a drive link mechanism 20 to cause swing motion of the upper feed bar 2 back and forth.

The rotation of the main shaft causes swing motion of the bushing 6 and the upper feed bar 2 and simultaneously, axial motion of the upper feed bar 2 within the bushing 6. The combined swing and axial motions give the lower end of the upper feed bar 2 an elliptical motion in a plane in which the central axis of the upper feed bar 2 is included and in the direction in which the workpieces W1 and W2 are fed. As a result, an elliptical motion is given to the upper feed dog 9 of the feed element 9 mounted to the lower end of the upper feed bar 2.

The presser bar 3, which is located behind the upper feed bar 2, is supported by a bushing 22 and vertically slidable within the bushing 22. The bushing 22 is fittingly mounted within the machine head A. A presser foot 25 is mounted to the lower end of the presser bar 3 through a presser holder 23 and a presser arm 24. The presser holder 23 is secured to the lower end of the presser bar 3. The presser arm 24 has an upper end fixed to the presser bar 3. The presser foot 25 is pivotally connected to the lower end of the presser arm 24 and swingable about a horizontal pivot pin 27. A presser spring 28 is disposed around the presser bar 3. The presser spring 28 has an upper end engaged with the lower end of a threaded stopper (not shown) threaded to the upper end of the presser bar 3, and a lower end engaged with a spring seat 30 extending from the outer peripheral surface of the presser bar 3.

With this arrangement, the presser foot 25 is biased downwardly against the needle plate C under the action of the presser spring 28. When the workpieces W1 and W2 are fed on the needle plate C, an upper force is applied through the workpieces to the presser foot 25 against the action of the presser spring 28. The presser foot 25 as well as the presser arm is then raised to clamp the workpieces W1 and W2 between the presser foot 25 and the upper surface of the needle plate C. The presser foot 25 is swung about the pivot pin 27 so as to change its angle of inclination relative to the presser arm 24. Thus, the workpieces W1 and W2 can constantly be clamped between the needle plate C and the entire upper surface of the presser foot 25. The upper end of the threaded stopper extends up to the upper section of the machine head A. A control knob (not shown) is mounted to the upper end of the threaded stopper and is effective to adjust the force of the presser spring 28.

A pair of front and rear lower feed dogs 33 and 34 are mounted within the machine bed B below the needle plate C. The front lower feed dog 33 and the upper feed dog 9 are arranged in a face-to-face relationship through a hole 35 formed in the needle plate C and a hole 36 formed in the front portion of the presser foot 25. The rear lower feed dog 34 and the lower surface of the rear portion of the presser foot 25 are also arranged in a face-to-face relationship through a hole 37 formed in the needle plate C. The front and rear lower feed dogs 33 and 34 are connected to the main shaft within the machine head A through a known transmission mechanism mounted within the machine bed B. The lower feed dogs 33 and 34 are given an elliptical motion in a vertical plane in the direction in which the workpieces W1 and W2 are fed.

The elliptical motion of the lower feed dogs 33 and 34 is responsive to the vertical motion of the needle 5. More specifically, when the bottom tip of the needle 5 is located above the needle plate C, the lower feed dogs 33 and 34 rise above the needle plate C, as shown in FIG. 1, so as to push the presser foot 25 upwardly. At this time, the lower feed dogs 33 and 34 are moved within the respective holes 35 and 37 to impart a feed motion to the workpieces W1 and W2 clamped between the presser foot 25 and the lower feed dogs 33 and 34. On the other hand, the lower feed dogs 33 and 34 are located below the needle plate C and returned to their forward position when the bottom tip of the needle 5 is positioned below the needle plate C to form stitches in the workpieces W1 and W2.

The upper feed dog 9 and the corresponding front lower feed dog 33 are both elliptically moved, but in opposite directions and phases. More specifically, when the bottom tip of the needle 5 is positioned above the needle plate C, the upper feed dog 9 is moved closer to the needle plate C as shown in FIG. 1. At this time, the upper feed dog 9 is moved to the rear along the hole 36 of the presser foot 25 to impart a feed motion to the workpieces. On the other hand, when the bottom tip of the needle 5 is moved below the needle plate C to sew the workpieces W1 and W2 together, the bottom tip of the needle 5 is moved a distance away from the needle plate C and returned to its forward position.

As shown in FIG. 1, a downward force is applied to the upper feed dog 9 from the workpieces W1 and W2 below the presser foot 25. The upper feed dog 9 cooperates with the lower feed dog 33 to clamp the workpieces W1 and W2 and impart a feed motion thereto. Since a feed motion is applied to opposite sides of the workpieces W1 and W2, they are fed to the path of the needle without any displacement.

Figure 4:
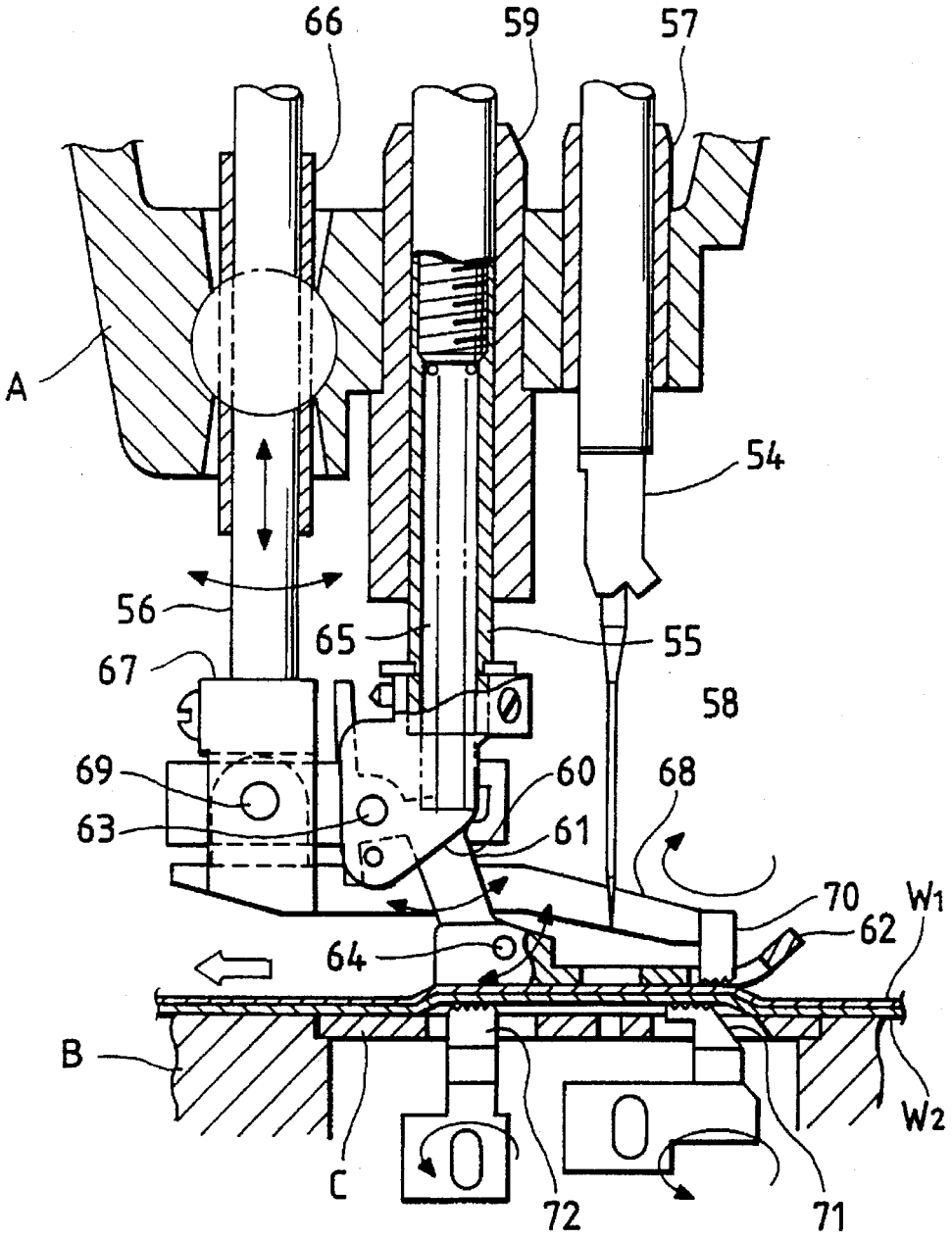
FIG. 4 PRIOR ART
FIG. 4 is a sectional side view of a part of a conventional sewing machine with an upper feed mechanism, located adjacent to the path of a needle.

In this embodiment, the feed bar 2 is located between the needle bar 1 and the presser bar 3. By this arrangement, the distance between the fulcrum (rear end) of the feed element 8 carried by the lower end of the upper feed bar 2 and the upper feed dog 9 positioned at the distal end of the feed element 8 is significantly shorter than that in the conventional sewing machine (see FIG. 4).

As the feed element 8 is less in length, size, weight and moment than that used in the conventional sewing machine, the upper feed dog 9 is highly responsive to the rapid motion of the lower feed dog. Thus, the upper feed dog 9 is prevented from bouncing until the sewing machine is operated at a substantially high speed.

The bouncing of the upper feed dog can be prevented without the need to increase the force of the spring 7 disposed around the upper feed bar 2 and adapted to urge the feed element 8. A feed motion can be imparted to the workpieces W1 and W2 only by a small amount of clamping force. Thus, the sewing machine of the present invention is able to sew knitted material or highly resilient and fragile material at high speeds.

Also, the distance between the fulcrum of the feed element 8 and the upper feed dog 9 at the distal end of the feed element is short, the clamping force of the upper feed dog 9 can readily be increased by increasing the force of the spring 7 disposed around the upper feed bar 2. Thus, the sewing machine can be used to sew superimposed jeans or other substantially thick garments.

Moreover, the small and lightweight feed element 8 reduces the amount of vibration and noise.

According to the present invention, the sewing machine is additionally provided with a spreader mechanism 41. To form a flat seam, for example, the spreader mechanism feeds a spreader thread (cover thread) to a location immediately before the needle 5. The spreader thread is moved in a direction transversely of needle threads.

The spreader mechanism 41 comprises a swing arm 42 journaled for rotation about the presser bar 3 in a horizontal plane, and a drive mechanism 43 adapted to pivotally move the swing arm 42 in a horizontal plane in timed relation to the needle 5.

Figure 2:
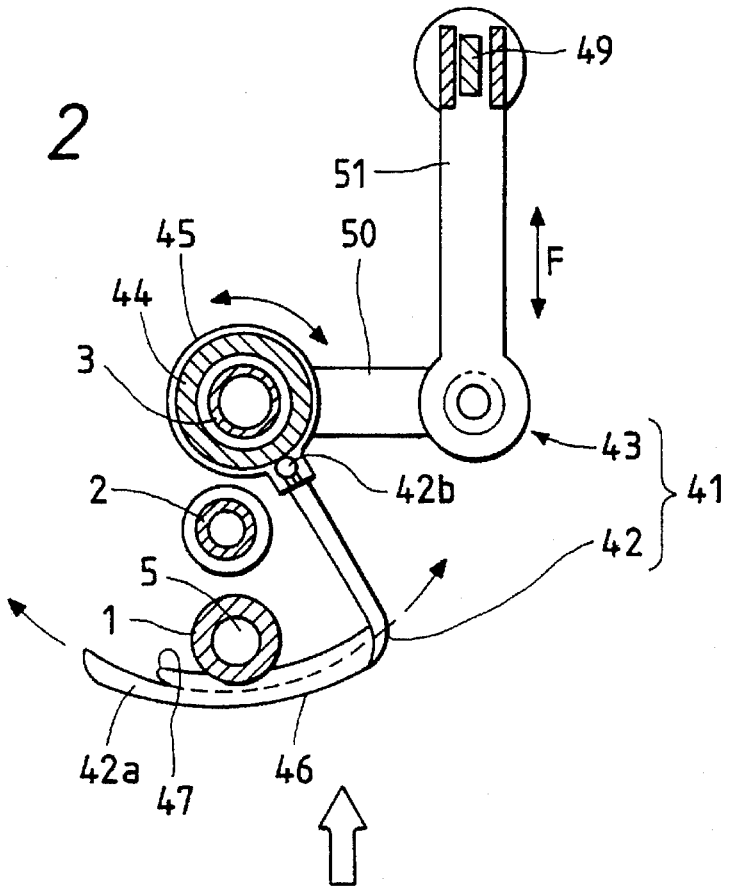
FIG. 2 is a sectional view taken along the line II—II of FIG. 1.
Figure 3:
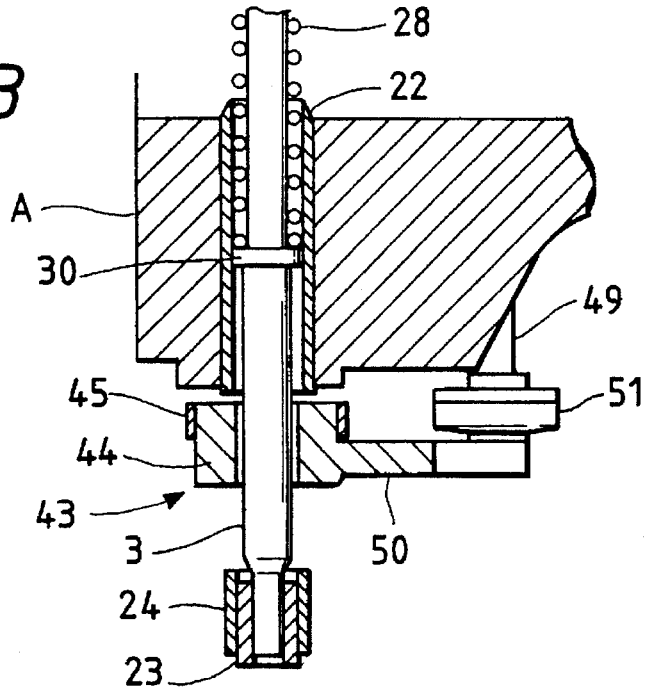
FIG. 3 is a sectional view taken along the line III—III of FIG. 1.

As shown in FIGS. 2 and 3, the swing arm 42 is rotatably mounted to the presser bar 3. Specifically, an annular member 44 is loosely fit around the presser bar 3 above the presser holder 23. A mount 45 is adapted to fixedly mount a base end (upper end) **42*b* of the swing arm 42 to the annular member 44**.

The sewing arm 42 extends obliquely downward from its base end **42*b* to near the needle plate C, passes on one side of the upper feed bar 2 and the needle bar 1, extends along the needle plate C, and is curved toward the needle bar 1. The swing arm 42 is curved to provide a thin spatulate member 46. A pawl 47 is formed in a distal end 42*a* of the member 46 to engage the spreader thread. The swing arm 42 is rotated with a radius such that the pawl 47 is moved immediately before the needle 5**.

The drive mechanism 43 comprises a swing shaft 48 (FIG. 1) driven by a main shaft within the machine head A through an eccentric cam shaft (not shown) and swung about its own axis with a predetermined radius, and a link mechanism adapted to transmit the swing motion of the swing shaft 48 to the annular member 44 mounted to the presser bar 3.

The link mechanism comprises a vertical drive arm 49 fixedly mounted to the forward end of the swing shaft 48, a horizontal drive arm 50 (FIG. 2) secured to the annular member 44 loosely fit around the presser bar 3, and a link member 51 having one end connected to the lower end of the vertical drive arm 49 and rotatable in a vertical plane and the other end connected to the forward end of the horizontal drive arm 50 and rotatable in a horizontal plane.

With this arrangement, upon rotation of the main shaft, the vertical drive arm 49 is swung back and forth (arrow E in FIG. 1) The swing motion of the vertical drive arm 49 causes the link member 51 to move back and forth (arrow F in FIGS. 1 and 2). The motion of the link member 51 then causes the horizontal drive arm 50 to swing in a horizontal plane. The swing arm 42 mounted to the annular member 44 is then swung in a horizontal plane with a predetermined radius.

The sewing arm 42 is swung in timed relation to the motion of the needle 5, for example, one or a few strokes of the needle 5, or every vertical swinging of the needle 5. The spatulate member 46 is moved above the workpieces W1 and W2 so as to feed a spreader thread to a location between the workpieces W1 and W2 and needle threads from the needle 5.

In the sewing machine of the present invention, the swing arm 42 is journaled in the presser bar 3 which is located more remotely than the feed bar from the needle bar 1. This arrangement permits the swing arm 42 to swing with a greater radius and to feed a thread to be interwoven between a plurality of needle threads.

The presser bar 3 serves as a drive shaft for the swing arm 42. Advantageously, this arrangement permits the swing arm 42 to be arranged in a space wherein the moving components of various mechanisms are closely arranged. The presser bar 3 is moved only axially within the bushing 22 as stated above. Thus, the swing arm 42 of the spreader mechanism 41 in no way prevents the motion of the presser bar 3.

In this embodiment, the swing arm 42 is journaled in the presser bar 3. Alternatively, the bushing 22 as a bearing may be extended coaxially downwardly to journal the swing arm 42. This alternative arrangement offers similar or even better advantages.

Illustratively, the drive mechanism 43 is in the form of a link mechanism, but not limited thereto. It may be combined with gear or other mechanisms.

The present invention provides the following significant advantages.

(1) In the sewing machine according to the invention, the second drive shaft for driving the feed element is located between the first drive shaft for driving the needle and the third drive shaft for driving the presser foot. This arrangement permits the distance between the fulcrum of the feed element carried by the lower end of the second drive shaft and the upper feed dog or working point to be substantially shortened. The short, small and lightweight feed element has smaller moment and enables the upper feed dog to be highly responsive to the rapid motion of the corresponding lower feed dog. The upper feed dog will not bounce until the sewing machine is operated at a substantially high speed. As such, an appropriate feed motion can be imparted to opposite sides of the workpieces in a constant manner to provide high quality stitches or seams.

(2) In the sewing machine according to the invention, the third drive shaft is effective to drive both the presser foot and the swing arm. Advantageously, this arrangement permits the swing arm to be mounted in a space wherein the moving components of various mechanisms are closely arranged.

Also, the third drive shaft is more distant than the second drive shaft from the first drive shaft for driving the needle. As the swing arm is mounted to this third drive shaft for rotation in a horizontal plane, it can be rotated with a greater radius and can feed a thread to be interwoven between a plurality of needle threads.

What is claimed is:

1. An upper feed mechanism for a sewing machine having a sewing machine head, the upper feed mechanism cooperating with a lower feed dog located below a needle plate to clamp and feed a workpiece in a workpiece feeding direction, the upper feed mechanism comprising:

a first shaft extending from the sewing machine head toward the needle plate, the first shaft having a lower end;

a needle secured to the lower end of the first shaft;

a second shaft positioned more downstream than the first shaft in the workpiece feeding direction, the second shaft extending from the sewing machine head toward the needle plate and having a lower end;

a feed element having one end supported by the lower end of the second shaft and the other end located more upstream than the needle location;

an upper feed dog formed in the other end of the feed element, the upper feed dog confronting the needle plate;

a third shaft positioned more downstream than the second shaft in the workpiece feeding direction, the third shaft extending from the sewing machine head toward the needle plate and having a lower end; and a presser foot mounted to the lower end of the third shaft.

2. An upper feed mechanism according to claim 1, wherein the presser foot extends upstream over the upper feed dog, and the presser foot has a hole for receiving the upper feed dog.

3. An upper feed mechanism for a sewing machine having a sewing machine head, the upper feed mechanism cooperating with a lower feed dog located below a needle plate to clamp and feed a workpiece in a workpiece feeding direction, the upper feed mechanism comprising:

a first shaft extending from the sewing machine head toward the needle plate, the first shaft having a lower end;

a needle secured to the lower end of the first shaft:

a second shaft positioned more downstream than the first shaft in the workpiece feeding direction, the second shaft extending from the sewing machine head toward the needle plate and having a lower end;

a feed element having one end supported by the lower end of the second shaft;

an upper feed dog formed in the other end of the feed element, the upper feed dog being confronting the needle plate;

a third shaft positioned more downstream than the second shaft in the workpiece feeding direction, the third shaft extending from the sewing machine head toward the needle plate and having a lower end; and a presser foot mounted to the lower end of the third shaft; and a swing arm rotatably mounted to the third shaft or journaled in a bearing coaxially with the third shaft, for feeding a thread to a location immediately forward of the needle, the thread being moved in a direction transversely of the needle threads.

4. An upper feed mechanism according to claim 2, wherein the presser foot extends upstream over the upper feed dog, and the presser foot has a hole for receiving the upper feed dog.

5. An upper feed mechanism for a sewing machine having a sewing machine head, the upper feed mechanism cooperating with a lower feed dog located below a needle plate to clamp and feed a workpiece in a workpiece feeding direction, the upper feed mechanism comprising:

a first shaft extending from the sewing machine head toward the needle plate, the first shaft having a lower end;

a needle secured to the lower end of the first shaft;

a second shaft positioned more downstream than the first shaft in the workpiece feeding direction, the second shaft extending from the sewing machine head toward the needle plate and having a lower end;

a feed element having one end supported by the lower end of the second shaft;

an upper feed dog formed in the other end of the feed element, the upper feed dog confronting the needle plate;

a third shaft positioned more downstream than the second shaft in the workpiece feeding direction, the third shaft extending from the sewing machine head toward the needle plate and having a lower end; and a presser foot mounted to the lower end of the third shaft, wherein the second shaft includes:

a stopper mounted at the lowermost end thereof;

an annular member mounted above the presser foot; and a spring having one end urging the annular member downward.

6. An upper feed mechanism according to claim 3, wherein the presser foot extends upstream over the upper feed dog, and the presser foot has a hole for receiving the upper feed dog.

7. A sewing machine with an upper feed mechanism, the sewing machine comprising:

a sewing machine head;

a needle plate;

first, second and third shafts each extending from the sewing machine head vertically downwardly toward the needle plate, each shaft having a lower end;

a needle secured to the lower end of the first shaft;

a feed element having one end carried by the lower end of the second shaft and the other end located forwardly of the path of the needle;

an upper feed dog formed in the other end of the feed element and confronting the needle plate; and a presser foot mounted to the lower end of the third shaft, wherein the first, second and third shafts being moved in timed relation to one another so as to allow a workpiece to be sandwiched between the presser foot and the needle plate, and the upper feed dog cooperating with a lower feed dog located below the needle plate to clamp and feed the workpiece to the path of the needle whereby stitches are formed, and wherein the first, second and third shafts are juxtaposed in that order in the direction in which the workpiece is fed.

8. An upper feed mechanism according to claim 7, wherein the presser foot extends upstream over the upper feed dog, and the presser foot has a hole for receiving the upper feed dog.

9. A sewing machine with an upper feed mechanism, the sewing machine comprising:

a sewing machine head;

a needle plate;

first, second and third shafts each extending from the sewing machine head vertically downwardly toward the needle plate, each shaft having a lower end;

a needle secured to the lower end of the first shaft;

a feed element having one end carried by the lower end of the second shaft;

an upper feed dog formed in the other end of the feed element and confronting the needle plate;

a presser foot mounted to the lower end of the third shaft, wherein the first, second and third shafts being moved in timed relation to one another so as to allow a workpiece to be sandwiched between the presser foot and the needle plate, and the upper feed dog cooperating with a lower feed dog located below the needle plate to clamp and feed the workpiece to the path of the needle whereby stitches are formed, and wherein the first, second and third shafts are juxtaposed in that order in the direction in which the workpiece is fed; and a swing arm rotatably mounted to the third shaft or journaled in a bearing in coaxial with to the third shaft and adapted to feed a thread to a location immediately forwardly of the needle, the thread being moved in a direction transversely of needle threads.

10. An upper feed mechanism according to claim 9, wherein the presser foot extends upstream over the upper feed dog, and the presser foot has a hole for receiving the upper feed dog.

* * * * *